US006934399B2

(12) United States Patent
Kam

(10) Patent No.: US 6,934,399 B2
(45) Date of Patent: Aug. 23, 2005

(54) PISTON-TYPE PANEL-FORM LOUDSPEAKER

(76) Inventor: Tai-Yan Kam, 4th Fl., No. 3, 2nd Alley, 86th Lane, Chien Kung 1st Rd., Hsin Chu (TW)

( * ) Notice: Subject to any disclaimer, the term of this patent is extended or adjusted under 35 U.S.C. 154(b) by 19 days.

(21) Appl. No.: 10/728,411

(22) Filed: Dec. 5, 2003

(65) Prior Publication Data

US 2004/0234087 A1 Nov. 25, 2004

(30) Foreign Application Priority Data

May 19, 2003 (TW) ..... 92113479 A

(51) Int. Cl.[7] ..... H04R 25/00
(52) U.S. Cl. ..... 381/152; 381/403; 381/431; 381/433
(58) Field of Search ..... 381/386, 396, 381/398, 400, 401, 403, 404, 431, 433, 152, 338, 151, 412, 420

(56) References Cited

U.S. PATENT DOCUMENTS 6,192,136 B1 * 2/2001 Azima et al. ..... 381/338
6,332,029 B1 * 12/2001 Azima et al. ..... 381/152
6,618,487 B1 * 9/2003 Azima et al. ..... 381/152

* cited by examiner

*Primary Examiner*—Huyen Le
(74) *Attorney, Agent, or Firm*—Madson & Metcalf

(57) ABSTRACT

A panel-form loudspeaker includes a radiating panel, a frame, a suspension unit, a transducer and a linkage unit. The frame is used for supporting and positioning the radiating panel. The suspension unit is disposed between the frame and the bottom periphery of the radiating panel, and is made of a soft material. The transducer includes a voice coil unit and a magnet unit. The voice coil unit is coupled to the radiating panel at a specific location under the radiating panel. The linkage unit includes a first linking portion coupled to the frame, a second linking portion coupled to the voice coil unit via a resilience support, and a third linking portion coupled to the magnet unit.

15 Claims, 10 Drawing Sheets

PISTON-TYPE PANEL-FORM LOUDSPEAKER

FIELD OF THE INVENTION

The present invention relates to a panel-form loudspeaker, and more particularly to a piston-type panel-form loudspeaker for radiating sound by means of a piston-type movement.

BACKGROUND OF THE INVENTION

A conventional loudspeaker utilizes a round-shaped electromagnetic transducer to drive a cone-type membrane to radiate sound. In general, an additional enclosure is necessary to facilitate sound radiation, which makes the loudspeaker cumbersome, weighty and having dead corner for sound radiation, etc. Recently, flat display and mobile communication devices such as notebook, cellular phone and personal digital assistant (PDA), are rapidly developed toward miniaturization. The integration of transparent panel-form loudspeakers with the flat display and mobile communication devices can greatly enhance the performance of such devices. Therefore, this conventional loudspeaker is gradually replaced by a panel-form loudspeaker.

FIGS. 1(*a*) and 1(*b*) are a top view and a cross-sectional view of a traditional panel-form loudspeaker, respectively. This panel-form loudspeaker radiates sound by exciting a radiating panel to produce flexural vibration. Such panel-form loudspeaker 1 comprises a frame 11, a radiating panel 12, an electromagnetic transducer 13 and a suspending unit 14. The frame 11 is in a rectangular shape with a hollow region in the center thereof. The cross section of the frame 11 is substantially L-shaped. The horizontal and the vertical portion of the L-shaped cross section are referred hereinafter as a bottom portion and a peripheral portion, respectively. The suspending unit 14 are attached onto and supported by the bottom portion of the frame 11. The radiating panel 12 is positioned by the peripheral portion of the frame 11. The suspending unit 14 comprises a plurality of separate strips. These strips can be selected from rubber-impregnated strips, foam type continuous strips and corrugated shell strips.

The transducer 13 is attached to the bottom surface of the radiating panel 12 and principally comprises a magnet unit and a voice coil unit. The magnet unit comprises a disk-shaped top plate 131, a cylindrical permanent magnet 132 and a permeance unit 133 such that a magnetic field is generated in a gap therebetween. The voice coil unit comprises a contact sheet 134 and a coil 135. Thus, when electric current flows through the coil 135, the voice coil unit will generate a motion in a direction vertical to the magnetic field so as to excite the radiating panel 12 to generate flexural vibration and radiate sound. The resilience support 136 is employed to fix the voice coil unit to be immersed in the magnetic field between the top plate 131, the permanent magnet 132 and the permeance unit 133. In general, the resilience support 136 also works as a damper to suppress undesirable vibrations of the radiating panel.

The transducer 13 is usually arranged at a specified location of the radiating panel to produce an effective modal vibration. Since the arrangement of resilience support 136 facilitates increasing rigidity of the radiating panel, some undesirable effects occur. For example, a relatively higher initial response frequency and considerable fluctuations are found on the sound pressure spectrum over the audible frequency range. In addition, when input power is augmented, a more apparent non-linear relation exists between the pressure response and the power. Please refer to FIG. 1(*b*). As known, the increasing area of the resilience support 136 facilitates overcoming the above-mentioned problems. However, the increasing area requires a larger permeance unit 133 because the resilience support 136 is coupled to the permeance unit 133. Due to the larger size of the permeance unit 133, the cost, the magnetic loss and the volume of the overall transducer will be inevitably increased.

The process for assembling the above panel-form loudspeaker will be described in brief as follows. Firstly, the strips of the suspending unit 14 are attached onto the bottom portion of the frame 11. Then, the transducer 13 is attached to a bottom surface of the radiating panel 12 at a specified location thereof. Afterwards, the radiating panel 12 is attached onto the suspending unit 14 so as to assemble the panel-form loudspeaker.

The above-mentioned assembling process has some problems. For example, it is time-consuming when a large number of strips are used. Some strips may be deviated from their designed locations, which impairs uniformity of the product. Moreover, the step of attaching the transducer 13 onto the bottom surface of the radiating panel 12 should be performed mechanically to achieve precise alignment at the specified location. The cost associated to the precise alignment will be increased if the dimension of the radiating panel changes.

SUMMARY OF THE INVENTION

It is an object of the present invention to provide a panel-form loudspeaker, which is easily assembled without the requirement of elaborate aligning procedure.

In accordance with a first aspect of the present invention, there is provided a panel-form loudspeaker. The panel-form loudspeaker comprises a radiating panel, a frame, a suspension unit, a transducer and a linkage unit. The frame is used for supporting and positioning the radiating panel. The suspension unit is disposed between the frame and the bottom periphery of the radiating panel, and is made of a soft material. The transducer comprises a voice coil unit and a magnet unit. The voice coil unit is coupled to the radiating panel at a specific location under the radiating panel. The linkage unit comprises a first linking portion coupled to the frame, a second linking portion coupled to the voice coil unit via a resilience support, and a third linking portion coupled to the magnet unit.

In an embodiment, the specific location is at the center of the radiating panel.

In an embodiment, the radiating panel is a laminate plate with an intermediate core layer sandwiched between two composite layers.

In an embodiment, the intermediate core layer of the laminate plate is made of Balsa wood (*Ochroma* spp.), and the composite layer of the laminate plate is made of a material selected from a group consisting of a glass fiber-reinforced polymeric resin, a carbon fiber-reinforced polymeric resin, a Kevlar fiber-reinforced polymeric resin and a boron fiber-reinforced polymeric resin.

In an embodiment, the first linking portion comprises two hooks. The frame comprises two slots corresponding to the two hooks, respectively, so as to be engaged with the two hooks.

In an embodiment, the second linking portion comprises a ring-shaped protrusion.

In an embodiment, the third linking portion comprises a cylinder with a gap on the circumference thereof.

In an embodiment, the magnet unit comprises a top plate, a permeance unit and a permanent magnet. The permeance unit is enclosed by the inner wall of the cylinder of the third linking portion. The permanent magnet is disposed within the permeance unit, and has a top surface and a bottom surface coupled to the top plate and the permeance unit, respectively.

In an embodiment, the permeance unit is coupled to the third linking portion by means of a binder.

In an embodiment, the second linking portion has at least one energy-attenuating hole in the vicinity of the second linking portion.

Preferably, the suspension unit is a one-piece soft strip.

In an embodiment, the suspension unit comprises a first part and a second part coupled to the radiating plate and the frame, respectively.

In an embodiment, the suspension unit further comprises a raised part between the first part and the second part.

In accordance with a second aspect of the present invention, there is provided a panel-form loudspeaker. The panel-form loudspeaker comprises a radiating panel, a frame, a suspension unit, a transducer and a linkage unit. The frame is used for supporting and positioning the radiating panel. The suspension unit is disposed between the frame and the bottom periphery of the radiating panel, and is a one-piece soft strip. The transducer comprises a voice coil unit and a magnet unit. The voice coil unit is coupled to the radiating panel at a specific location under the radiating panel. The linkage unit comprises a first linking portion coupled to the frame, a second linking portion coupled to the voice coil unit via a resilience support, and a third linking portion coupled to the magnet unit.

In accordance with a third aspect of the present invention, there is provided a panel-form loudspeaker. The panel-form loudspeaker comprises a radiating panel, a frame, a suspension unit, a transducer and a linkage unit. The frame is used for supporting and positioning the radiating panel. The suspension unit is disposed between the frame and the bottom periphery of the radiating panel. The suspension unit is a one-piece soft strip and comprises a first part and a second part coupled to the radiating plate and the frame, respectively, and a raised part between the first part and the second part. The transducer comprises a voice coil unit and a magnet unit. The voice coil unit is coupled to the radiating panel at a specific location under the radiating panel. The linkage unit comprises a first linking portion coupled to the frame, a second linking portion coupled to the voice coil unit via a resilience support, and a third linking portion coupled to the magnet unit.

The above objects and advantages of the present invention will become more readily apparent to those ordinarily skilled in the art after reviewing the following detailed description and accompanying drawings, in which:

BRIEF DESCRIPTION OF THE DRAWINGS

FIG. 1(*b*) is a cross-sectional view of a panel-form loudspeaker in FIG. 1(*a*) along the line A—A;

FIG. 6(*b*) is a rear side view of a linkage unit used in the panel-form loudspeaker of the present invention;

DETAILED DESCRIPTION OF THE PREFERRED EMBODIMENT

Figure 1A:
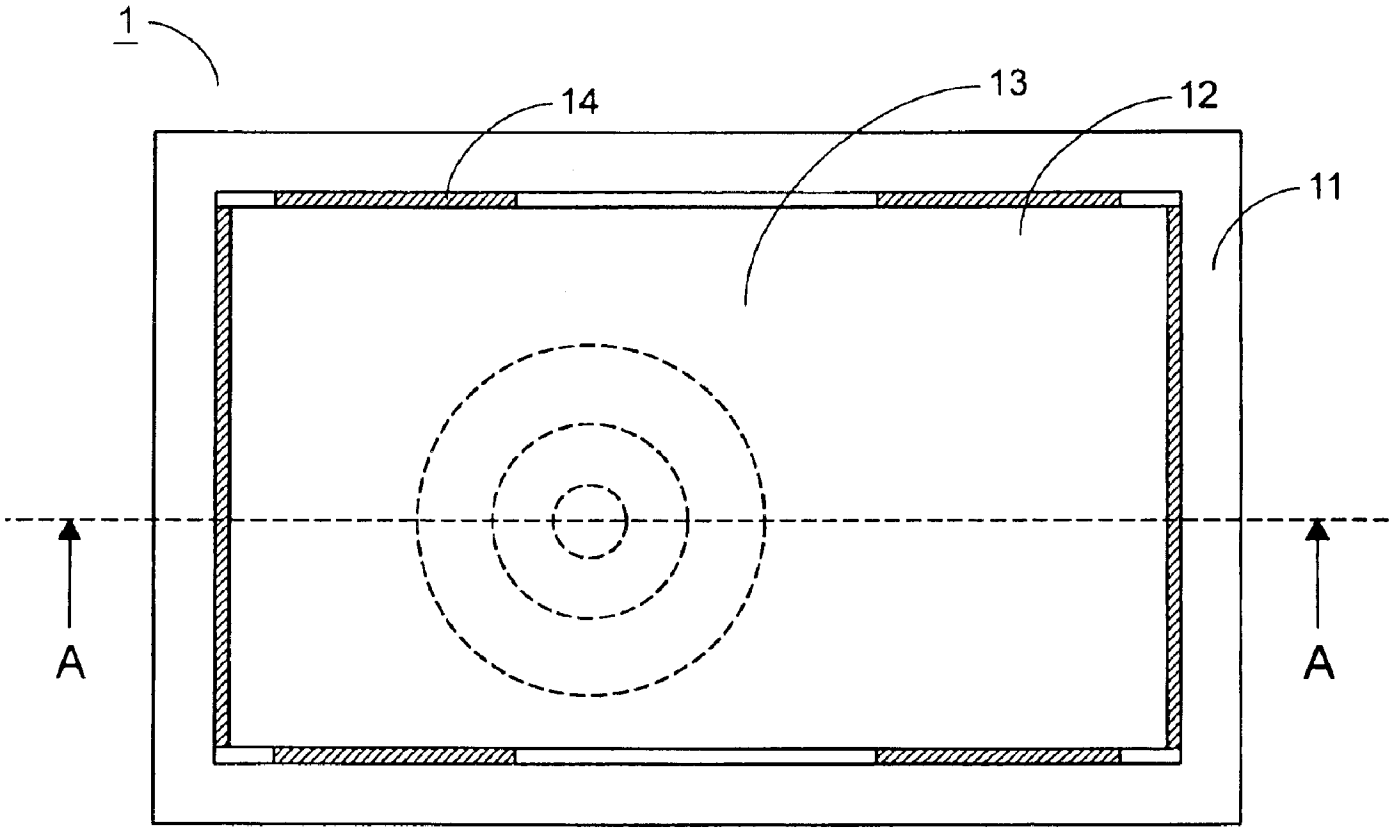
Fig.1(a) Prior Art
FIG. 1(*a*) is a top view of a panel-form loudspeaker according to prior art.
Figure 1B:
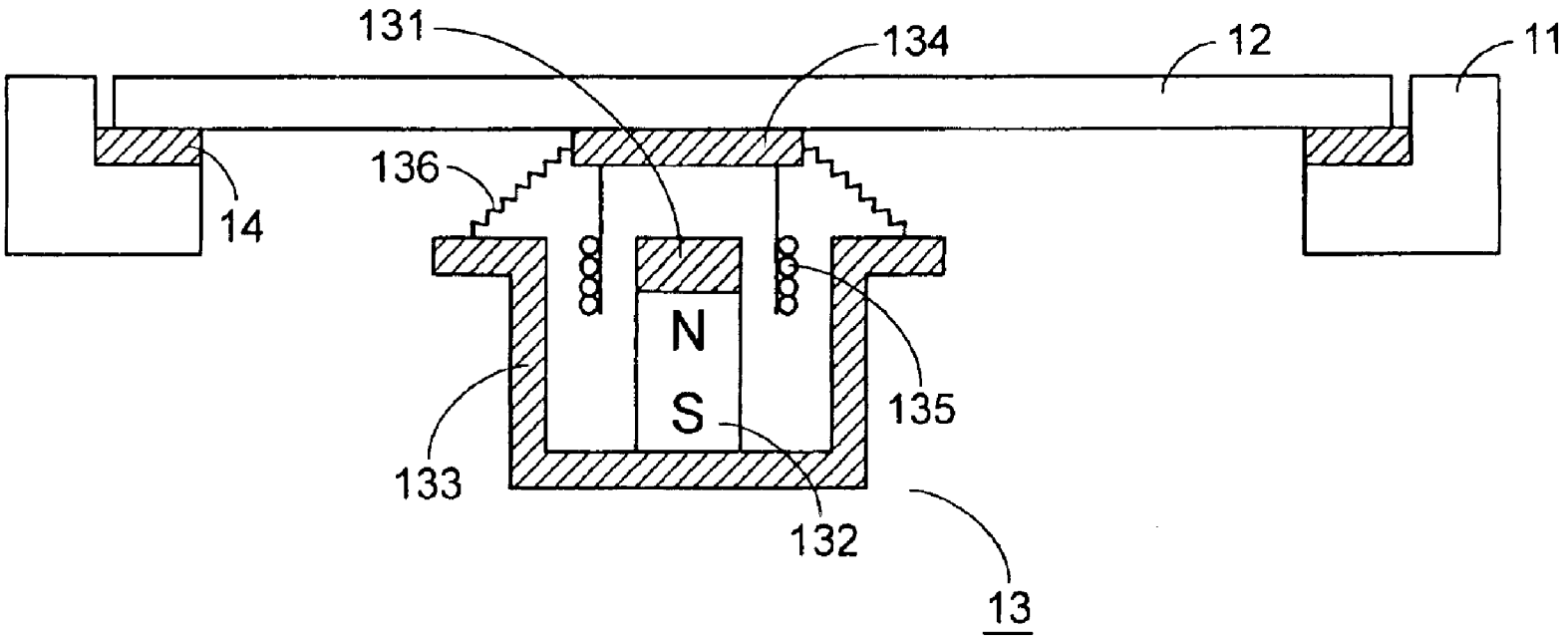
Fig. 1(b) Prior Art
Figure 2:
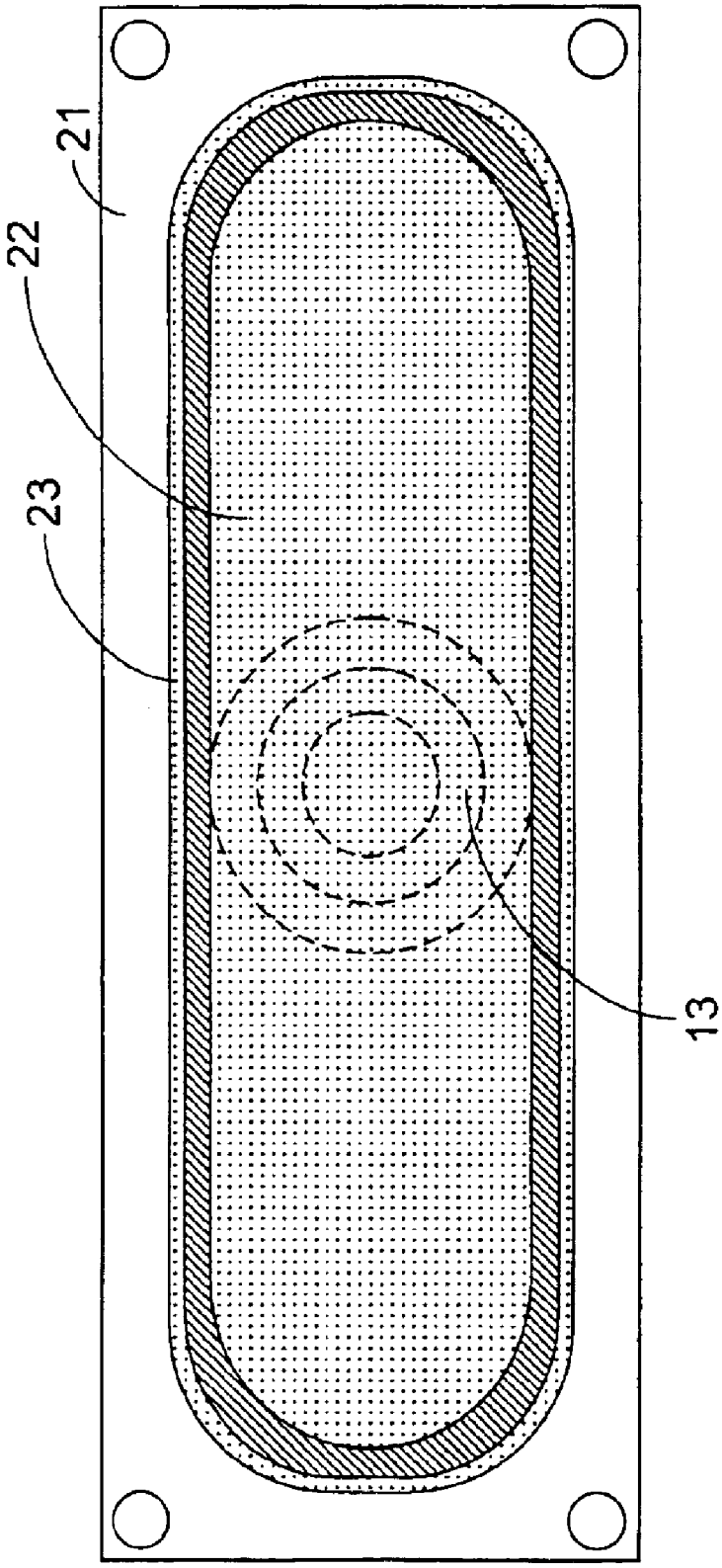
FIG. 2 is a top view of a panel-form loudspeaker according to a preferred embodiment of the present invention.
Figure 3:
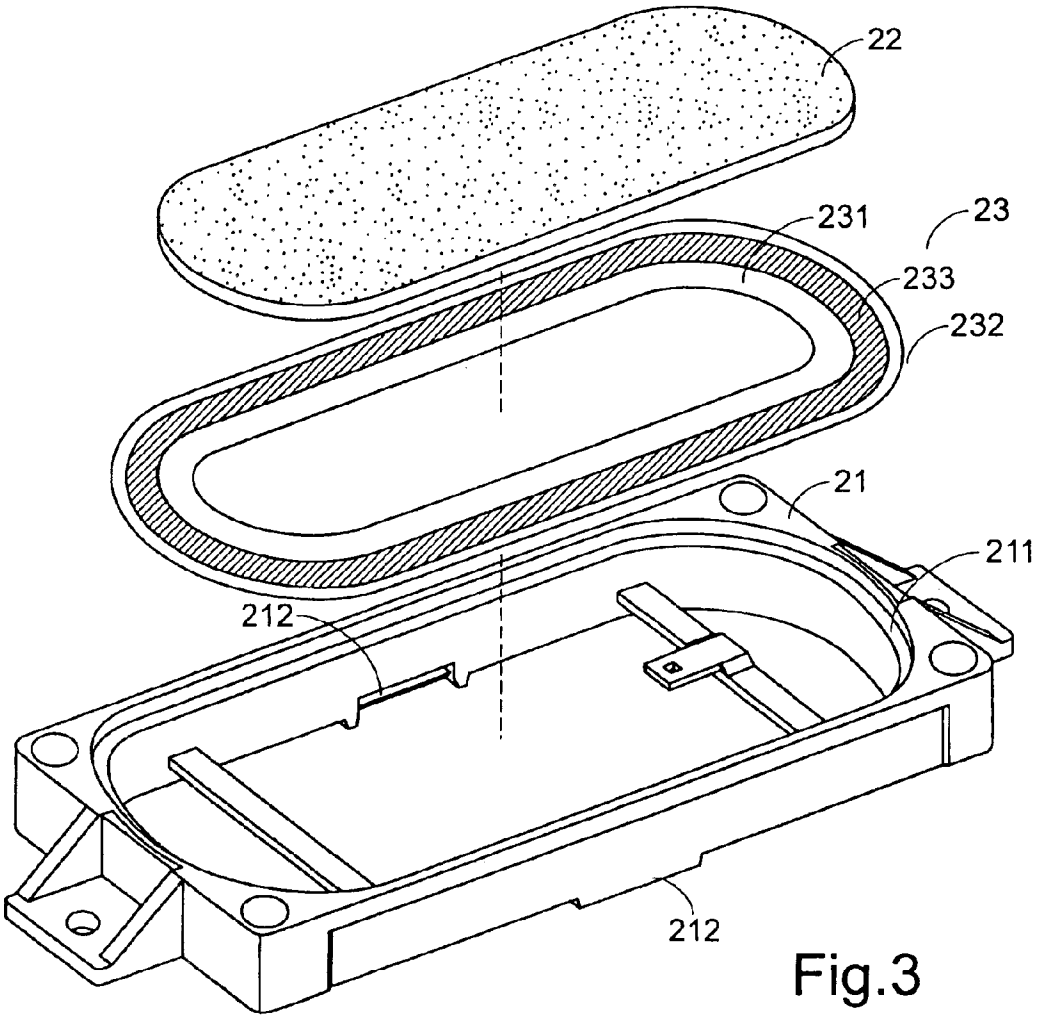
FIG. 3 is an exploded view of a frame/suspending unit/radiating panel assembly according to the present invention.

Please refer to FIGS. 2 and 3. According to an aspect of the present invention, a process for assembling a frame 21, a radiating panel 22 and a suspending unit 23 is shown.

The frame 21 is integrally formed by means of an injection molding process, and comprises a supporting portion 211 and two slots 212 facing to each other at the middle of the longitudinal side.

Figure 4:
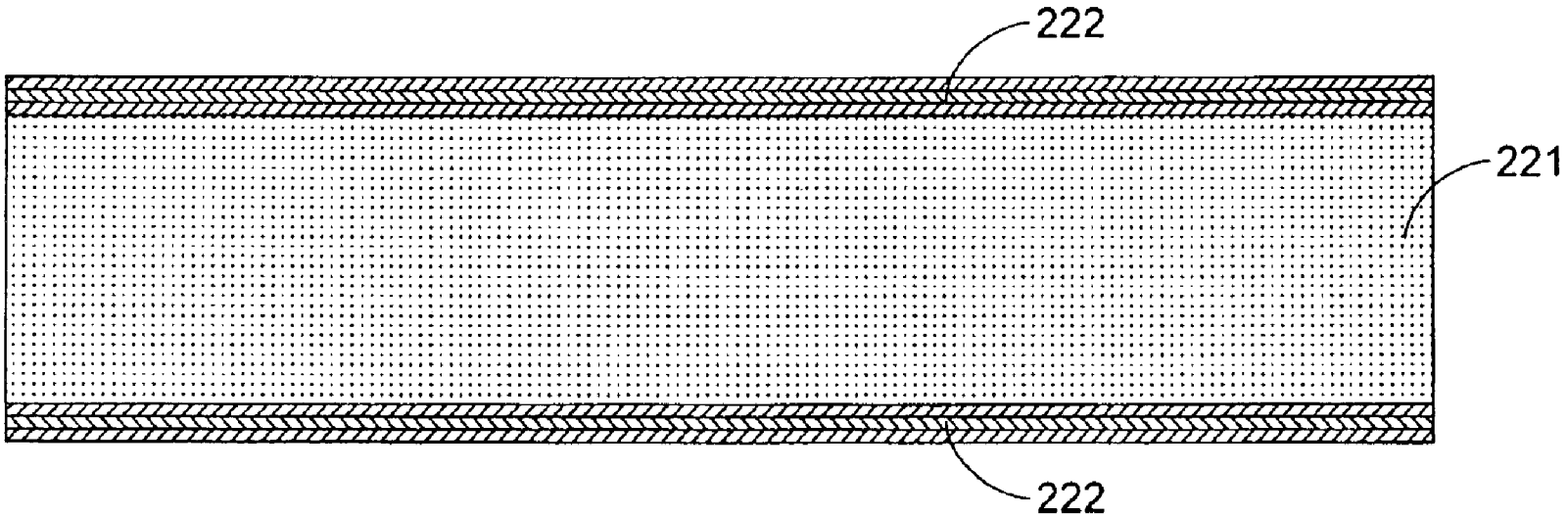
FIG. 4 is a cross-sectional view of a radiating panel according to the present invention.

The radiating panel 22 used in the present invention is a laminate plate with an intermediate core layer 221 sandwiched between two composite layers 222, as can be seen in FIG. 4. An example of the intermediate core layer 221 of the laminate plate is made of Balsa wood (*Ochroma* spp.). The composite layer 222 of the laminate plate can be formed from a glass fiber-reinforced polymeric resin, a carbon fiber-reinforced polymeric resin, a Kevlar fiber-reinforced polymeric resin or a boron fiber-reinforced polymeric resin. This laminate plate used as the radiating plate 22 is light and has a large rigidity so as to produce a sound pressure within an effective bandwidth by means of a rigid body motion.

As shown in FIG. 3, the suspending unit 23 is substantially a one-piece soft strip, and comprises a first part 231, a second part 232 and a raised part 233 between the first part 231 and the second part 232. The first part 231 and the second part 232 are coupled to the radiating plate 22 and the frame 21, respectively. The raised part 233 of the suspending unit 23 facilitates increasing response of the radiating panel 22.

Figure 5:
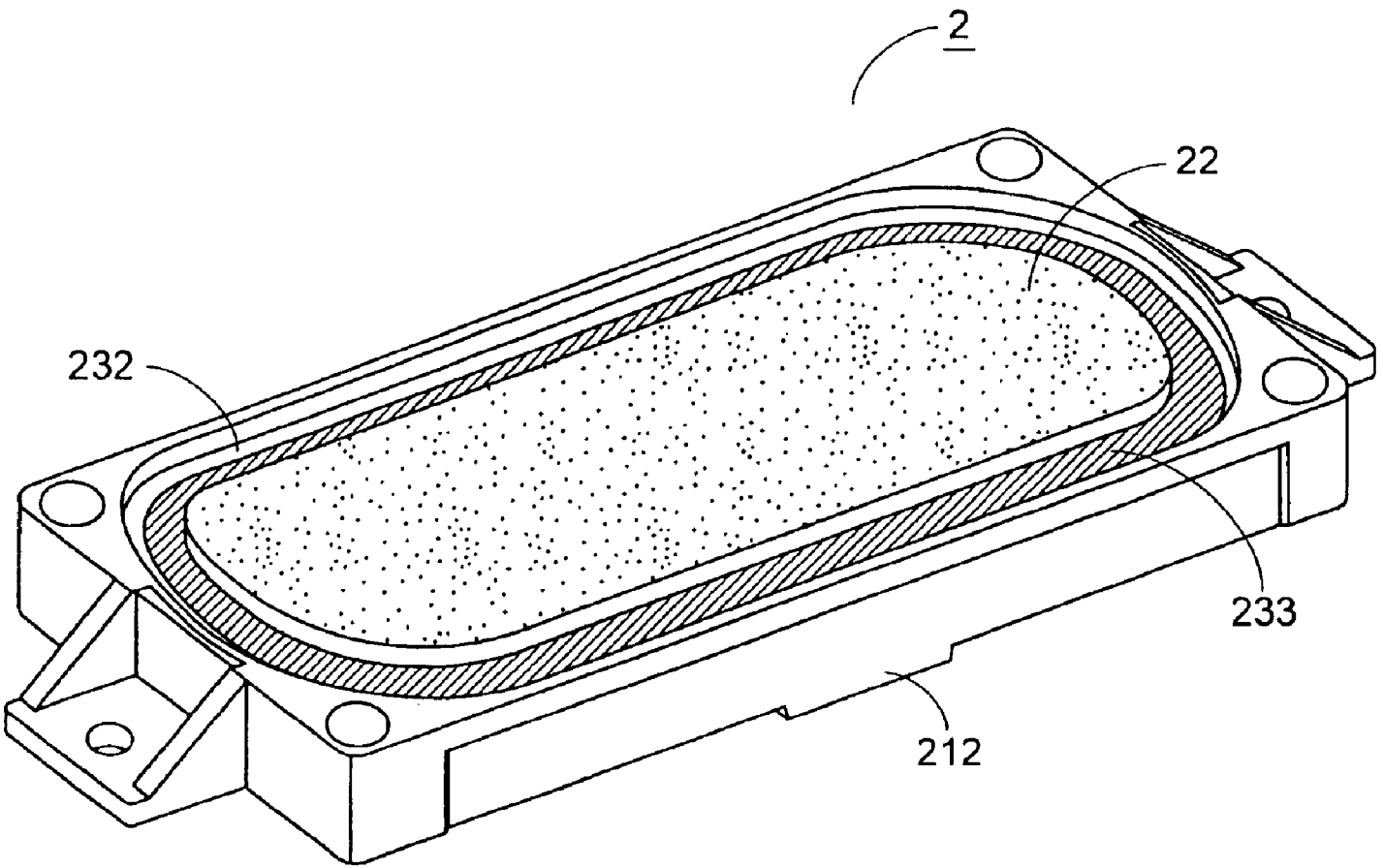
FIG. 5 is an exploded view of a resilience support/voice coil unit/magnet unit assembly according to the present invention.

The process for assembling the frame 21, the radiating panel 22 and the suspending unit 23 will be illustrated as follows. Firstly, the bottom periphery of the radiating panel 22 is attached onto the first part 231 of the suspending unit 23. Then, the second part 232 of the suspending unit 23 is attached onto the supporting portion 211 of the frame 21. Meanwhile, a frame/suspending unit/radiating panel assembly 2 is finished as shown in FIG. 5. Since the suspending unit 23 is a one-piece soft strip, a relatively shorter time period for attaching the one-piece soft strip onto the frame 21 and/or attaching the radiating panel 22 onto the one-piece soft strip is obtained, when comparing with the prior art.

Figure 6B:
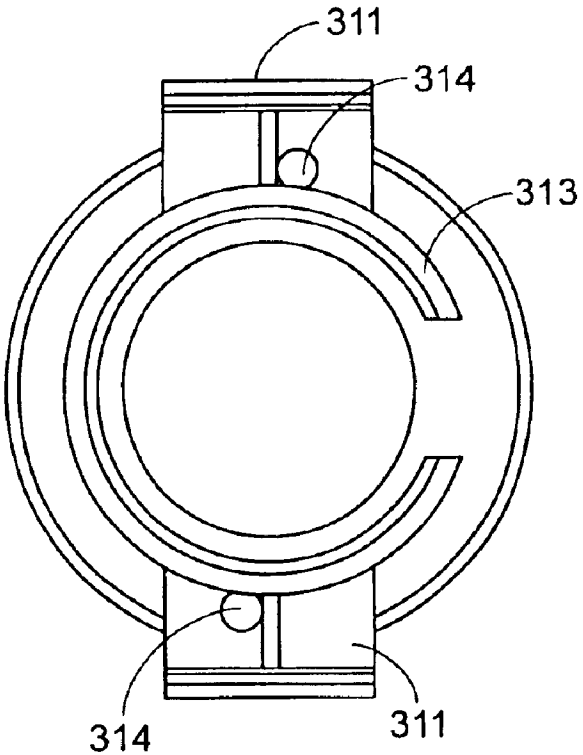
FIG. 6(*a*) is a front side view of a linkage unit used in the panel-form loudspeaker of the present invention.
Figure 6A:
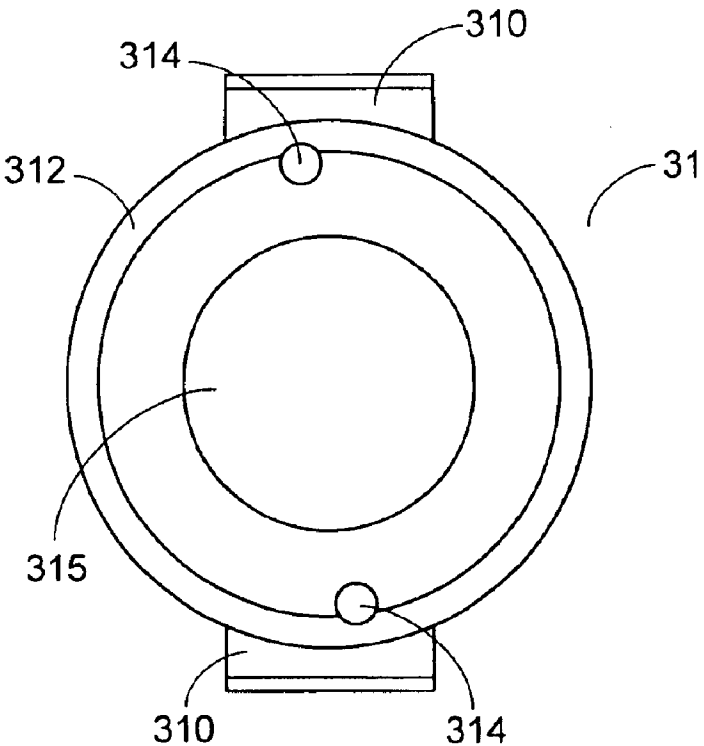

According to a further aspect of the present invention, a process for assembling a resilience support, a voice coil unit and a magnet unit is provided. A specific design of a linkage unit 31 is provided in order to achieve this object. In FIGS. 6(*a*) and 6(*b*), the linkage unit 3 comprises a first linking portion 311, a second linking portion 312 and a third linking portion 313. The first linking portion 311 comprises two hooks at peripheries of the ears 310 corresponding to the slots 212 of the frame 21 (as shown in FIG. 3), respectively. The second linking portion 312 of the linkage unit 31 is substantially a ring-shaped protrusion. The third linking portion 313 is substantially a cylinder with a gap on the circumference thereof. In addition, when the radiating panel is vibrated by means of the piston-type movement, the sound waves transmitted from the backside of the radiating panel will be accumulated in a space defined by a traducer attached to the radiating panel. The movement of these sound waves resembles the movement of an air-pressured spring, which might cause the sound pressure spectrum to shift toward right due to the increasing resonant frequency. For a purpose of preventing the shift of the sound pressure spectrum, there is at least one energy-attenuating hole 314 in the vicinity of the second linking portion 312.

Figure 7B:
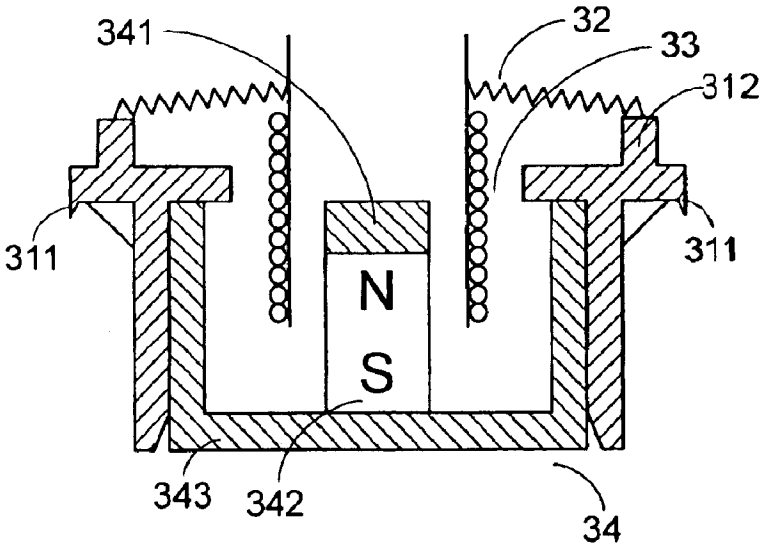
FIGS. 7(*a*)~7(*c*) illustrate a process for assembling the panel-form loudspeaker of the present invention.
Figure 7A:
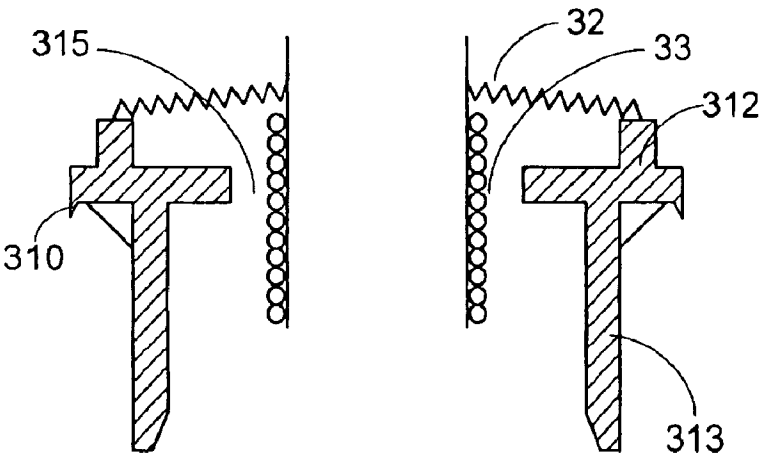
Figure 7C:
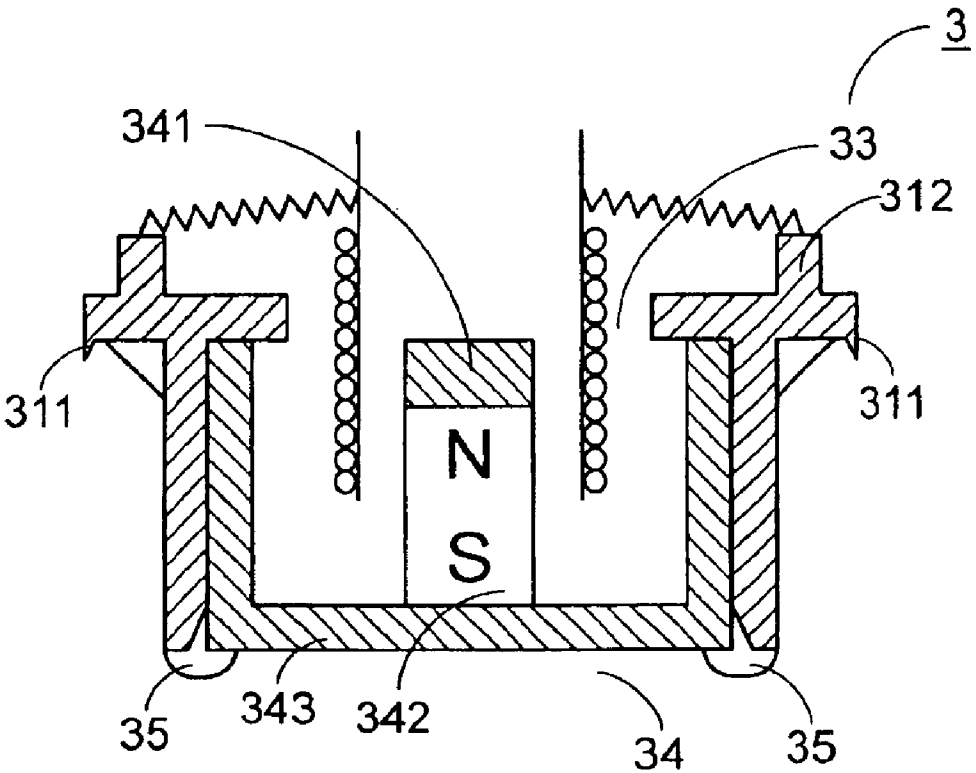
Figure 8:
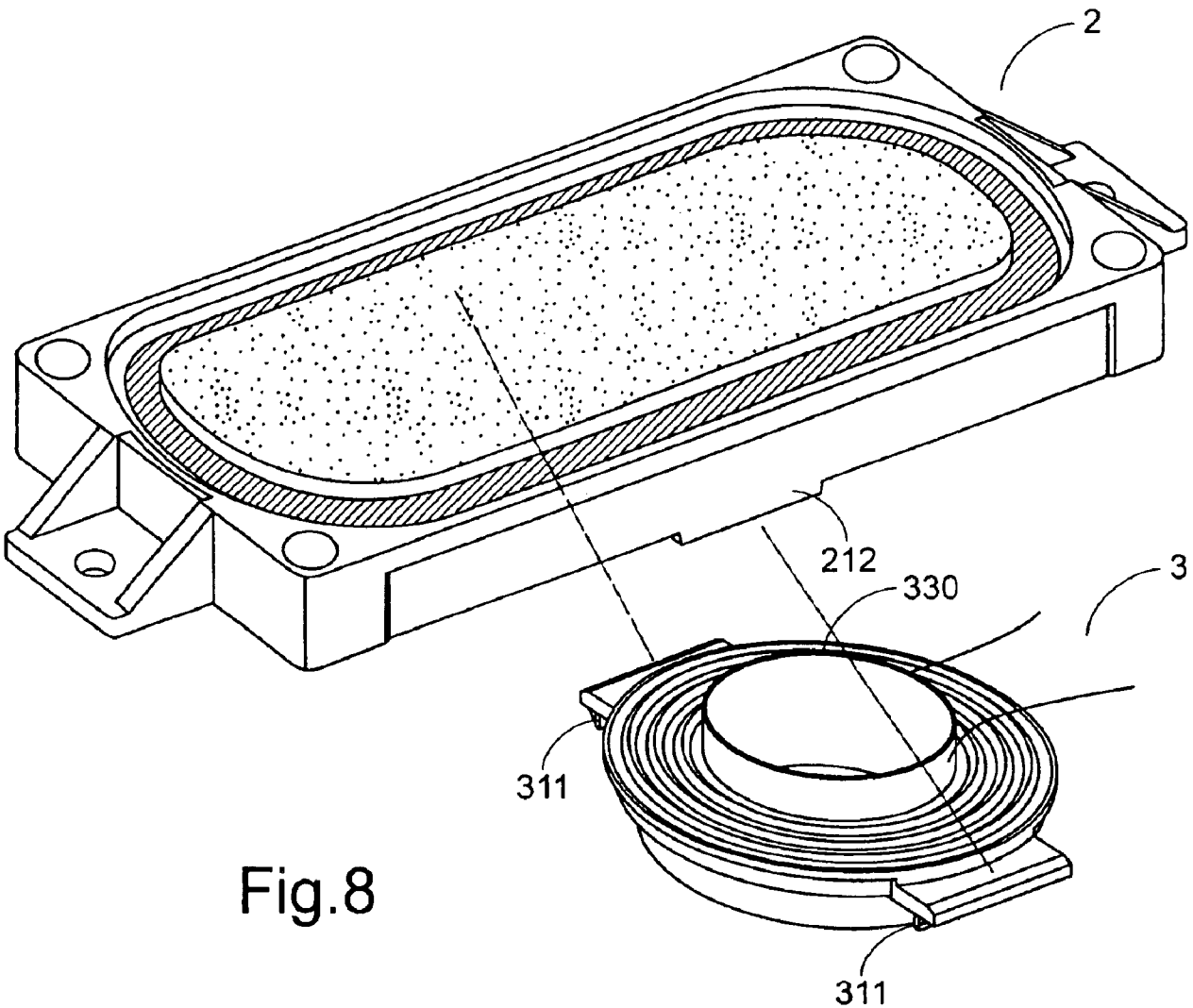
FIG. 8 is an exploded view illustrating the assembling process of the frame/suspending unit/radiating panel assembly and the resilience support/voice coil unit/magnet unit assembly and according to the present invention.

The process for assembling a resilience support 32, a voice coil unit 33 and a magnet unit 34 by using the linkage unit 31 is illustrated in FIGS. 7(*a*)~7(*c*). In FIG. 7(*a*), the voice coil unit 33 penetrates the central opening 315 of the linkage unit 31. Then, the inner periphery of the resilience support 32 and the second linking portion 312 of the linkage unit 31 are coated with binders. Subsequently, as shown in FIG. 7(*b*), a magnet unit 34 composed of a top plate 341, a permanent magnet 342 and a permeance unit 343 is enclosed by the inner wall of the cylinder of the third linking portion 313 so as to provide an initial positioning effect. Subsequently, as shown in FIG. 7(*c*), a binder 35 is applied between the outer wall of the cylinder of the third linking portion 313 and the permeance unit 343. In such way, a resilience support/voice coil unit/magnet unit assembly 3 is finished.

After the frame/suspending unit/radiating panel assembly 2 and the resilience support/voice coil unit/magnet unit assembly 3 are separately assembled, a binder is applied to the top edge 330 of the voice coil unit 33. When the hooks 311 of the linkage unit 31 is engaged with the slots 212 of the frame 21, the top edge 330 of the voice coil unit 33 is attached onto the bottom surface of the radiating panel 22 so as to finish the panel-form loudspeaker of the present invention.

Depending on the sizes of the resilience support 32 and the magnet unit 34, the distance between each linking portion and the center of the linkage unit 31 can be varied as required. For example, if a resilience support 32 having a larger area is required to overcome the disadvantages of the relatively higher initial response frequency and considerable fluctuations occurred in the prior art, the second linking portion 312 can be extended outward. If a lesser magnet unit 34 is needed, the inner diameter of the cylinder of the third linking portion 313 should be made smaller. If a larger frame 31 is used, the first linking portion 311 of the linkage unit 31 should be extended toward both ears thereof. Moreover, the engagement of the hooks 311 of the linkage unit 31 and the slots 212 of the frame 21 is advantageous for reducing cost associated to the precise alignment in the prior art.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A panel-form loudspeaker, comprising:

a radiating panel;

a frame for supporting and positioning said radiating panel;

a suspension unit disposed between said frame and the bottom periphery of said radiating panel, said suspension unit being made of a soft material;

a transducer comprising a voice coil unit and a magnet unit, said voice coil unit being coupled to said radiating panel at a specific location under said radiating panel; and a linkage unit comprising a first linking portion coupled to said frame, a second linking portion coupled to said voice coil unit via a resilience support, and a third linking portion coupled to said magnet unit;

wherein said first linking portion comprises two hooks, and said frame comprises two slots corresponding to said two hooks, respectively, so as to be engaged with said two hooks.

2. The panel-form loudspeaker according to claim 1 wherein said specific location is at the center of said radiating panel.

3. The panel-form loudspeaker according to claim 1 wherein said radiating panel is a laminate plate with an intermediate core layer sandwiched between two composite layers.

4. The panel-form loudspeaker according to claim 3 wherein said intermediate core layer of said laminate plate is made of balsa wood.

5. The panel-form loudspeaker according to claim 3 wherein said composite layer of said laminate plate is made of a material selected from a group consisting of a glass fiber-reinforced polymeric resin, a carbon fiber-reinforced polymeric resin, a Kevlar fiber-reinforced polymeric resin and a boron fiber-reinforced polymeric resin.

6. The panel-form loudspeaker according to claim 1 wherein said second linking portion comprises a ring-shaped protrusion.

7. The panel-form loudspeaker according to claim 1 wherein said third linking portion comprises a cylinder with a gap on the circumference thereof.

8. The panel-form loudspeaker according to claim 7 wherein said magnet unit comprises:

a top plate;

a permeance unit enclosed by the inner wall of said cylinder of the third linking portion; and a permanent magnet disposed within said permeance unit, and having a top surface and a bottom surface coupled to said top plate and said permeance unit, respectively.

9. The panel-form loudspeaker according to claim 8 wherein said permeance unit is coupled to said third linking portion by means of a binder.

10. The panel-form loudspeaker according to claim 1 wherein there is at least one energy-attenuating hole in the vicinity of said second linking portion.

11. The panel-form loudspeaker according to claim 1 wherein said suspension unit is a one-piece soft strip.

12. The panel-form loudspeaker according to claim 11 wherein said suspension unit comprises a first part and a second part coupled to said radiating plate and said frame, respectively.

13. The panel-form loudspeaker according to claim 12 wherein said suspension unit further comprises a raised part between said first part and said second part.

14. A panel-form loudspeaker, comprising:

a radiating panel;

a frame for supporting and positioning said radiating panel;

a suspension unit disposed between said frame and the bottom periphery of said radiating panel, wherein said suspension unit is a one-piece soft strip;

a transducer comprising a voice coil unit and a magnet unit, said voice coil unit being coupled to said radiating panel at a specific location under said radiating panel; and a linkage unit comprising a first linking portion coupled to said frame, a second linking portion coupled to said voice coil unit via a resilience support, and a third linking portion coupled to said magnet unit;

wherein said first linking portion comprises two hooks, and said frame comprises two slots corresponding to said two hooks, respectively, so as to be engaged with said two hooks.

15. A panel-form loudspeaker, comprising:

a radiating panel;

a frame for supporting and positioning said radiating panel;

a suspension unit disposed between said frame and the bottom periphery of said radiating panel, said suspension unit being a one-piece soft strip and comprising a first part and a second part coupled to said radiating plate and said frame, respectively, and a raised part between said first part and said second part;

a transducer comprising a voice coil unit and a magnet unit, said voice coil unit being coupled to said radiating panel at a specific location under said radiating panel; and a linkage unit comprising a first linking portion coupled to said frame, a second linking portion coupled to said voice coil unit via a resilience support, and a third linking portion coupled to said magnet unit;

wherein said first linking portion comprises two hooks, and said frame comprises two slots corresponding to said two hooks, respectively, so as to be engaged with said two hooks.

* * * * *